US012227998B1

(12) United States Patent
Duhon et al.

(10) Patent No.: US 12,227,998 B1
(45) Date of Patent: Feb. 18, 2025

(54) MULTI-PURPOSE COMPENSATOR SYSTEM

(71) Applicant: Advanced Tool & Supply, LLC, Broussard, LA (US)

(72) Inventors: Bryan Duhon, Sunset, LA (US); Shannon Duhon, Rayne, LA (US)

(73) Assignee: ADVANCED TOOL & SUPPLY, LLC, Broussard, LA (US)

( * ) Notice: Subject to any disclaimer, the term of this patent is extended or adjusted under 35 U.S.C. 154(b) by 0 days.

(21) Appl. No.: 18/477,143

(22) Filed: Sep. 28, 2023

Related U.S. Application Data

(60) Provisional application No. 63/411,332, filed on Sep. 29, 2022.

(51) Int. Cl.
*E21B 19/06* (2006.01)
*E21B 15/00* (2006.01)
*E21B 19/00* (2006.01)

(52) U.S. Cl.
CPC ..... *E21B 19/006* (2013.01); *E21B 15/003* (2013.01); *E21B 19/008* (2013.01); *E21B 19/06* (2013.01)

(58) Field of Classification Search
None
See application file for complete search history.

(56) References Cited

U.S. PATENT DOCUMENTS 6,276,454 B1 * 8/2001 Fontana ..... E21B 19/09 166/77.3
6,929,071 B2 8/2005 Moncus et al.
7,191,837 B2 3/2007 Coles
8,256,520 B2 * 9/2012 Lucas ..... B63B 35/4413 212/307
8,672,039 B2 * 3/2014 Miller, III ..... E21B 19/09 166/350
8,938,930 B2 * 1/2015 Bryant, Jr. ..... E21B 7/023 166/349
9,051,783 B2 * 6/2015 Croatto ..... E21B 19/006
9,297,220 B2 * 3/2016 Beck ..... E21B 19/22
9,611,706 B2 * 4/2017 Pinckard ..... E21B 3/022
9,677,345 B2 * 6/2017 Miller, Jr. ..... E21B 19/084
2004/0206551 A1 * 10/2004 Carriere ..... E21B 15/00 175/203
2007/0089884 A1 * 4/2007 Patton ..... E21B 33/06 166/77.2
2011/0067887 A1 * 3/2011 Moncus ..... E21B 19/22 166/77.2
2011/0308808 A1 * 12/2011 Miller, III ..... E21B 19/008 166/342

(Continued)

*Primary Examiner* — Matthew R Buck
*Assistant Examiner* — Douglas S Wood
(74) *Attorney, Agent, or Firm* — Jones Walker LLP

(57) ABSTRACT

A compensator system includes an expandable frame assembly configured to compensate for motion of a floating platform or vessel in relation to a seafloor below. The expandable frame assembly includes a retainer for supporting a tubular member and a tubular string below. When the expandable frame assembly is in a first position, a first tool assembly, such as a coiled tubing assembly, may be connected to the tubular string. Thereafter, the first tool assembly may be disconnected from the tubular string. The expandable frame assembly may then be moved into a second position, and a second tool assembly may then be connected to the tubular string.

16 Claims, 16 Drawing Sheets

(56) References Cited

U.S. PATENT DOCUMENTS

| | | | | |
|---|---|---|---|---|
| 2012/0067642 | A1* | 3/2012 | Magnuson | E21B 7/12 175/7 |
| 2012/0267117 | A1* | 10/2012 | Skinnes | E21B 19/006 166/360 |
| 2013/0195559 | A1* | 8/2013 | Andresen | E21B 19/002 405/224.4 |
| 2019/0330934 | A1* | 10/2019 | Wright | E21B 19/09 |
| 2021/0262298 | A1* | 8/2021 | Wright | E21B 19/10 |

* cited by examiner

MULTI-PURPOSE COMPENSATOR SYSTEM

CROSS-REFERENCE TO RELATED APPLICATIONS

This application claims the benefit of and priority to U.S. Provisional Patent Application No. 63/411,332, filed Sep. 29, 2022, which is incorporated herein by reference in its entirety.

BACKGROUND OF THE DISCLOSURE

Motion compensators are used on offshore floating platforms to compensate for wave action which results in vertical displacement of the platform deck. Prior art motion compensators are described in U.S. Pat. No. 7,191,837, issued on Mar. 20, 2007, to Coles, which is incorporated herein by reference, and U.S. Pat. No. 6,929,071, issued on Aug. 16, 2005, to Moncus et al., which is incorporated herein by reference. These prior art motion compensators fail, however, to allow for the easy exchange of different tool assemblies for connection to a tubular string. Thus, a motion compensator configured to facilitate the exchange of a first tool assembly for a second tool assembly is needed and disclosed herein.

SUMMARY OF THE DISCLOSURE

The disclosure relates to a compensator system. The compensator system may include an extendable frame assembly including a sliding platform disposed in an upper portion of the frame assembly. The compensator system may further include a retainer disposed within a central space of the frame assembly. The retainer may be configured to be secured to a tubular member for supporting the tubular member and a tubular string below. The compensator system may further include two or more supports extending from the upper portion of the frame assembly to the retainer, wherein the two or more supports are configured to suspend the retainer.

In another embodiment, the sliding platform may selectively slide between a first position over the central space and a second position that is a horizontal distance from the first position. An upper window may be opened when the sliding platform is in the second position.

In yet another embodiment, the sliding platform may be configured to support a first tool assembly.

In yet another embodiment, the compensator system may further include a swing arm crane secured to the upper portion of the frame assembly. The swing arm crane may be configured to lift and lower a second tool assembly through the upper window when the sliding platform is in the second position.

In yet another embodiment, each of the first tool assembly and the second tool assembly may be a coiled tubing assembly, a wireline assembly, a slick line assembly, or an electronic line assembly.

In yet another embodiment, the retainer may include an elevator.

In yet another embodiment, the retainer may include a side door elevator.

In yet another embodiment, the retainer may further include one or more rings secured to the side door elevator.

In yet another embodiment, the retainer may include a clamp.

In yet another embodiment, each of the two or more supports may include a cable.

In yet another embodiment, each of the two or more supports may include a cylinder.

In yet another embodiment, each cylinder may be a hydraulic cylinder.

In yet another embodiment, each cylinder may be a nitrogen cylinder.

In yet another embodiment, the compensator system may include four supports extending from the upper portion of the frame assembly to the retainer.

In yet another embodiment, the frame assembly may be configured to compensate for motion of a floating platform or vessel in relation to a seafloor below.

The disclosure also relates to a method. The method may include the step of providing a compensator system comprising: an extendable frame assembly including a sliding platform disposed in an upper portion; a retainer disposed within a central space of the frame assembly; two or more supports extending from the upper portion of the frame assembly to the retainer. The method may further include the step of positioning the compensator system on a vessel or a floating platform over a wellbore with one or more surface components of a tubular string positioned within the central space of the frame assembly, wherein the one or more surface components are suspended from a first tool assembly positioned on the sliding platform of the frame assembly, and wherein the tubular string extends into the wellbore. The method may further include the step of extending and retracting the frame assembly to compensate for a sea level change over time with the first tool assembly connected to the tubular string in line with the wellbore. The method may further include the step of securing the retainer to a tubular member of the one or more surface components. The method may further include the step of adjusting a position of the frame assembly to apply tension in the two or more supports extending from the upper portion of the frame assembly to the retainer. The method may further include the step of disconnecting the first tool assembly from the one or more surface components, and sliding the sliding platform to a second position a horizontal distance from the first position to transfer the first tool assembly out of line of the wellbore, wherein the two or more supports and the retainer supports a load of the one or more surface components and the tubular string below when the first tool assembly is disconnected. The method may further include the step of extending and retracting the frame assembly to compensate for a sea level change over time with the first tool assembly disconnected from the tubular string and out of line with the wellbore.

In another embodiment, the method may include the step of positioning a second tool assembly in the central space of the frame assembly in line with the wellbore, and connecting the second tool assembly to the tubular member to which the retainer is secured. The method may further include the step of extending and retracting the frame assembly to compensate for a sea level change over time with the second tool assembly connected to the tubular string in line with the wellbore.

In yet another embodiment, each of the first tool assembly and the second tool assembly may be a coiled tubing assembly, a wireline assembly, a slick line assembly, or an electronic line assembly.

In yet another embodiment, the first tool assembly may be a coiled tubing assembly and the second tool assembly may be a wireline assembly, a slick line assembly, or an electronic line assembly.

In yet another embodiment, the method may include the step of disconnecting the second tool assembly from the tubular member to which the retainer is secured and removing the second tool assembly from the central space of the frame assembly. The method may further include the step of sliding the sliding platform from the second position into a position that is in line with the wellbore to position the first tool assembly above the tubular member to which the retainer is secured. The method may further include the step of attaching the first tool assembly to the tubular member to which the retainer is secured. The method may further include the step of extending and retracting the frame assembly to compensate for a sea level change over time with the first tool assembly connected to the tubular string in line with the wellbore.

DETAILED DESCRIPTION OF THE PREFERRED EMBODIMENTS

Figure 1:
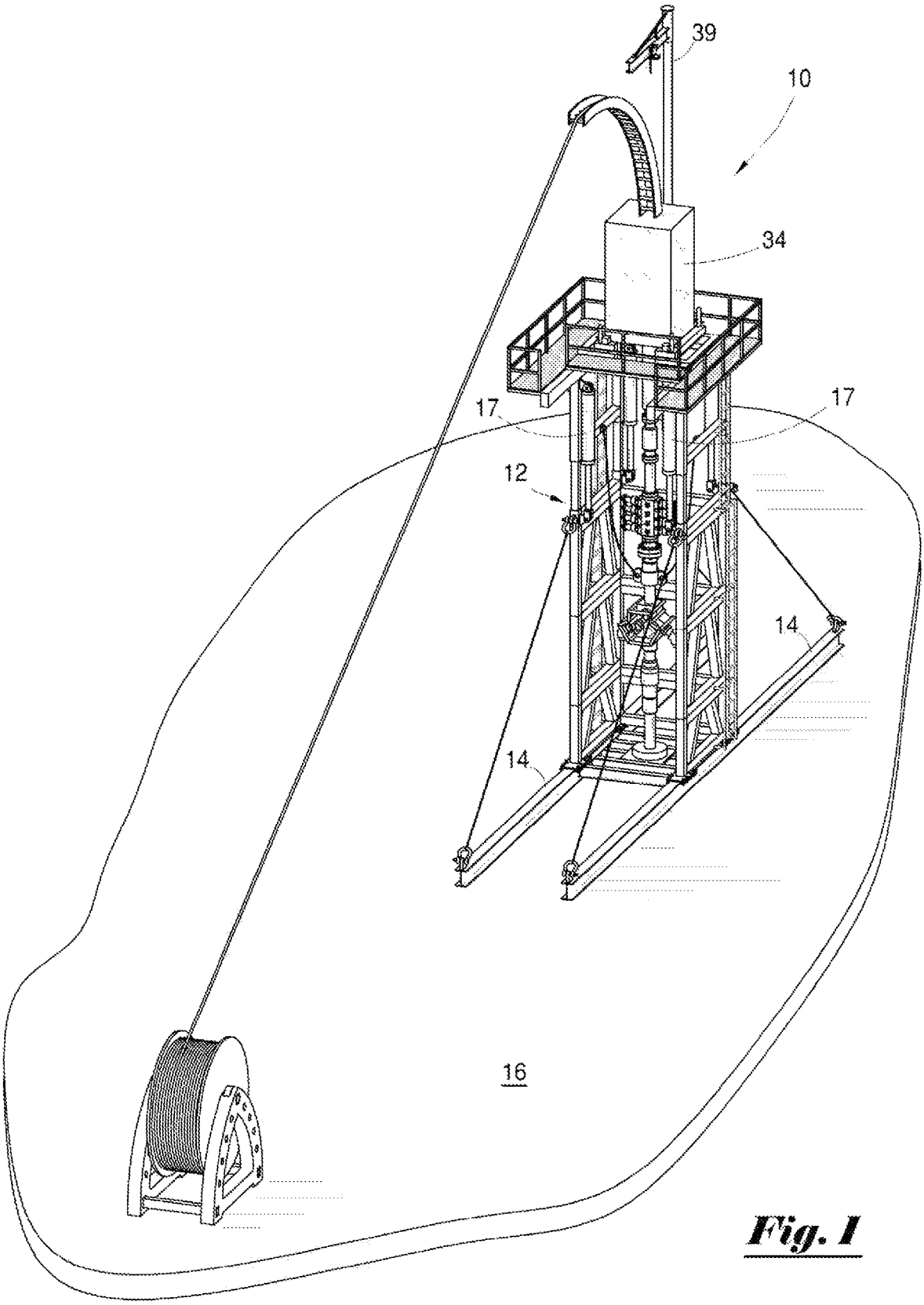
FIG. 1 is a perspective view of a compensator system disclosed herein with a coiled tubing spool and a first tool assembly supported by a sliding platform in a first position.
Figure 2:
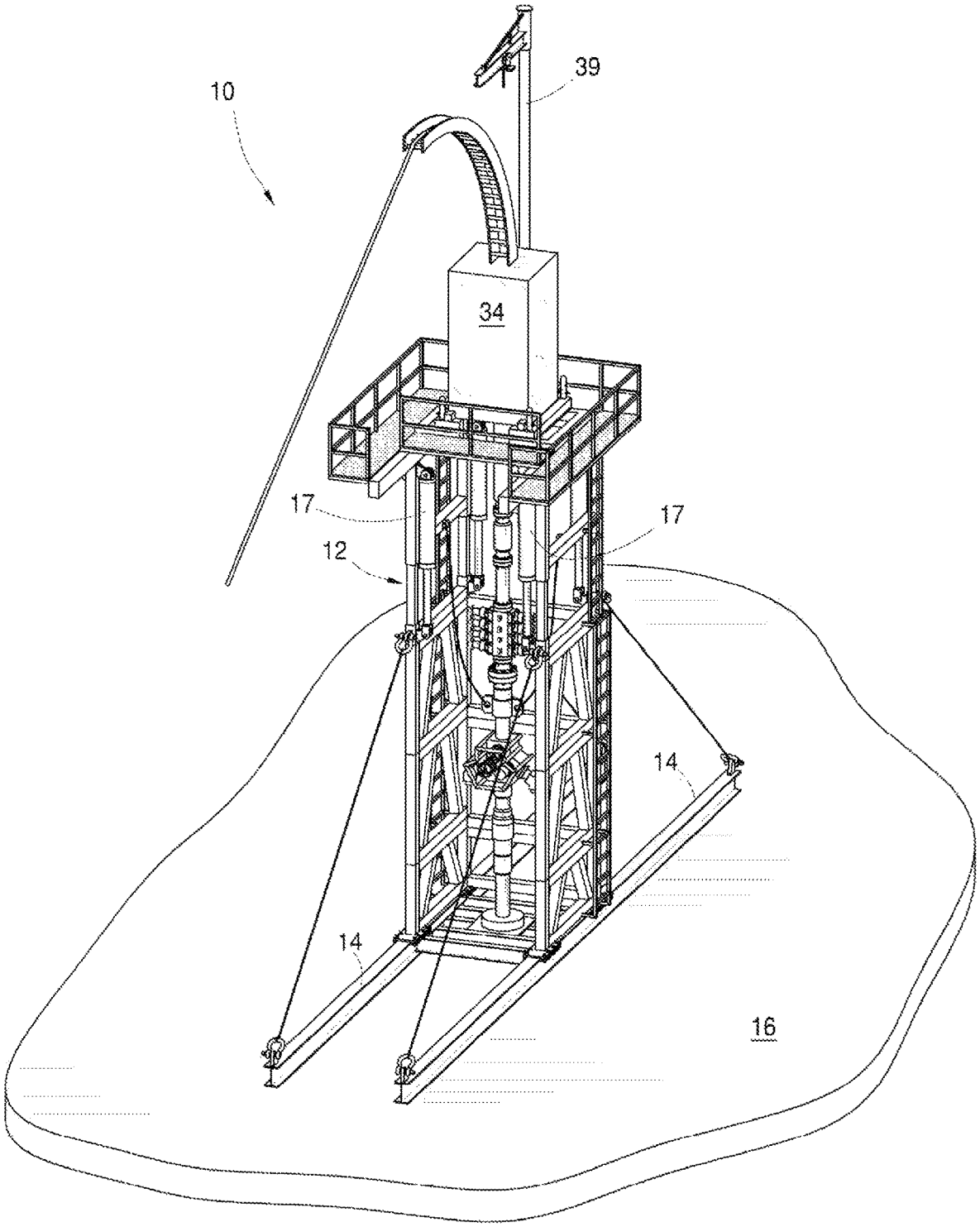
FIG. 2 is a partial perspective view of the compensator system shown in FIG. 1.
Figure 3:
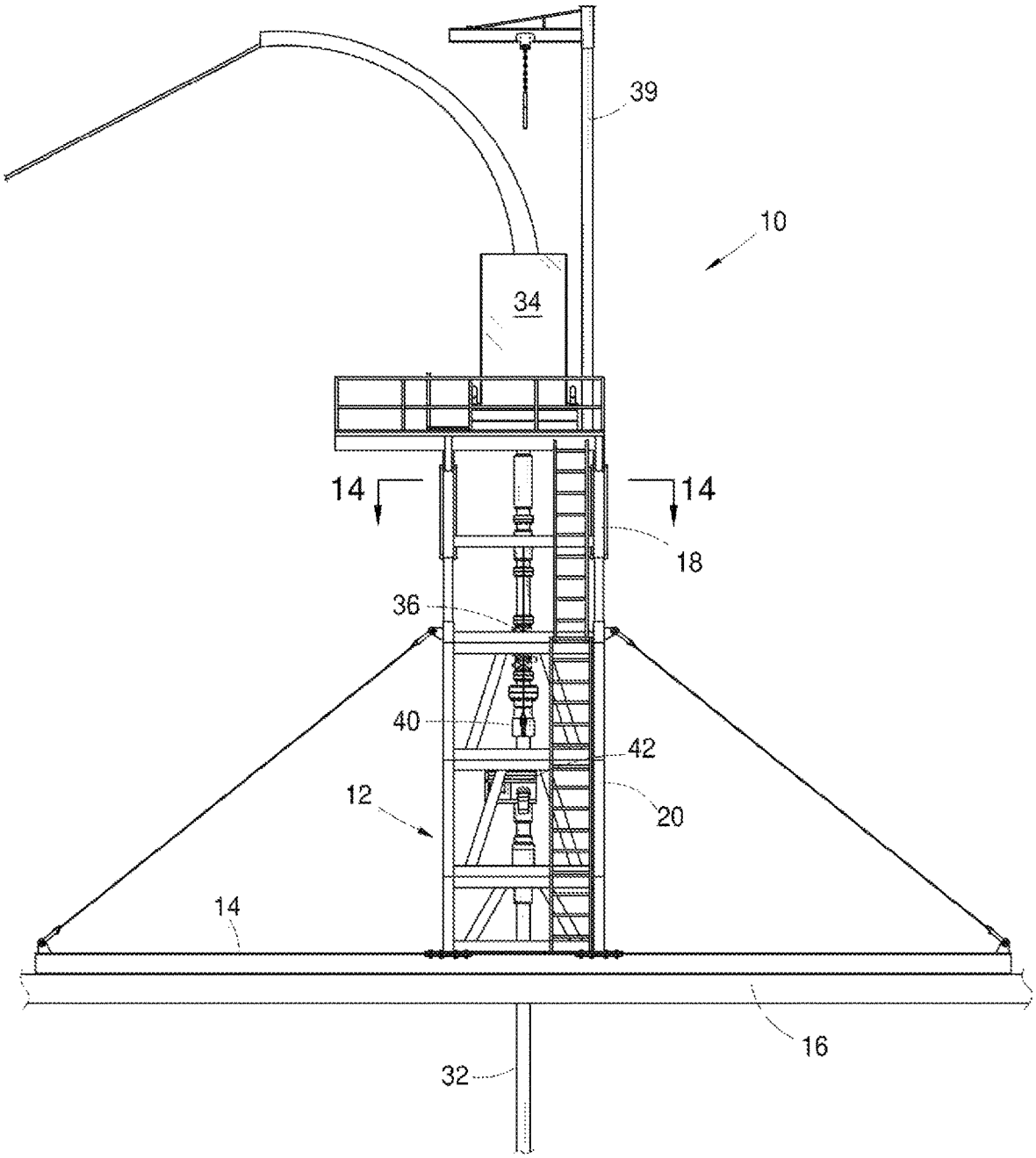
FIG. 3 is a side view of the compensator system in the position shown in FIG. 1.

A novel multi-purpose compensator system and method of use are disclosed herein. The compensator system includes an extendable frame assembly or tower configured to be supported on a floating platform or vessel, with a sliding platform disposed in an upper portion of the frame assembly, a retainer disposed within a central space of the frame assembly and configured to be secured to a tubular member, and two or more supports connecting the retainer to the upper portion of the tower frame.

A first tool assembly may be suspended from the sliding platform and secured to the tubular member of a tubular string, which extends into a subsea wellbore below the floating platform or vessel. In this configuration, the sliding platform and the frame assembly suspend the tubular string. The frame assembly may be extended and retracted to compensate for sea level changes over time while the first tool assembly is connected to the tubular string. If use of a second tool assembly is desired, the retainer may be secured to the tubular member within the central space of the frame assembly (if it was not already secured thereto), and the frame assembly may be extended to lift its upper portion, thereby applying tension to the two or more supports leading to the retainer. In this way, the retainer, through the supports and frame assembly, supports the tubular member and tubular string below. For this reason, the first tool assembly may thereafter be detached from the tubular member without the tubular string moving in relation to the vessel or floating platform due to sea level changes or waves. After detaching the first tool assembly, the sliding platform may be transferred from its first position over the wellbore to a second position that is horizontally spaced apart from the first position.

The second tool assembly may be positioned in the central space of the frame assembly and secured to the tubular member to which the retainer is attached. For example, the second tool assembly may be lowered into the central space through a window in the upper portion of the frame assembly that opens when the sliding platform moves into the second position. In other embodiments, the second tool assembly may be transferred into the central space of the frame assembly through an opening in a side of the frame assembly. Once the second tool assembly is attached to the tubular member, the retainer supports the second tool assembly. Accordingly, the frame assembly may be extended and retracted to compensate for sea motion with the first tool assembly connected and in line with the wellbore, with the second tool assembly connected and in line with the wellbore, and with no tool assembly connected above the retainer.

In various embodiments, the first tool assembly and/or second tool assemblies may each include a coiled tubing assembly, a wireline assembly, a slick line assembly, an electronic line assembly (i.e., e-line assembly), or any other assembly that may be secured to an upper end of the tubular string at the surface. The wireline assembly may include wireline pressure control equipment.

FIGS. 1-16 illustrate exemplary embodiments of the compensator system disclosed and claimed herein.

Referring to FIGS. 1-6, compensator system 10 may include frame assembly 12 supported on beams 14 that are attached to a floating platform or vessel 16. Floating platform or vessel 16 may be any type of floating platform or vessel. By way of example only, floating platform or vessel 16 may include a tension leg platform, a floating platform, a spar, or a vessel. Frame assembly 12 may be an expandable frame assembly. For example, upper portion 18 (shown in FIG. 3) of frame assembly 12 may be slidingly secured to lower portion 20 (shown in FIG. 3) of frame assembly 12 such that pressure cylinders 17 (e.g., hydraulic or pneumatic cylinders with reciprocating piston rods) may slide upper portion 18 in an upward and downward direction to expand and retract frame assembly 12. In this way, frame assembly 12 may compensate for sea motion experienced by the floating platform or vessel 16 in relation to the sea floor.

Figure 14:
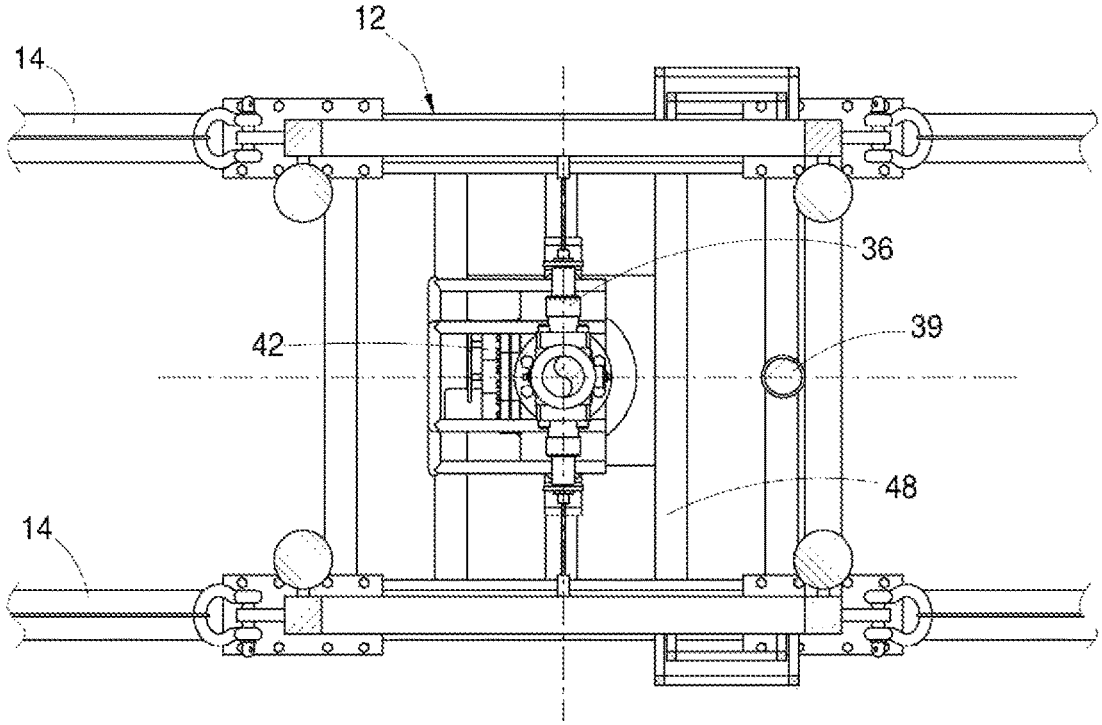
FIG. 14 is a top view of the compensator system in the position shown in FIG. 1.
Figure 15:
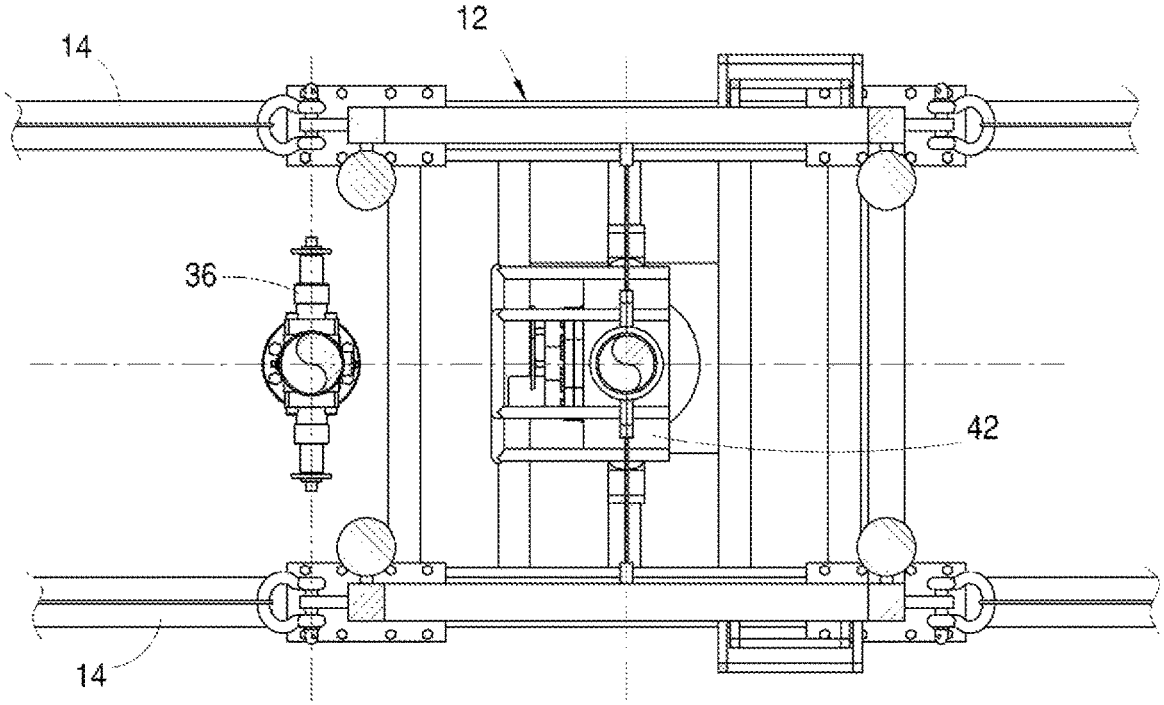
FIG. 15 is a top view of the compensator system in the position shown in FIG. 11.

With specific reference to FIGS. 5-6 and 14, upper portion 18 of frame assembly 12 may include sliding platform 30 configured to support and suspend a first tool assembly and a tubular string 32 secured below the first tool assembly. The first tool assembly may be any type of tool assembly. By way of example only, sliding platform 30 may support a coiled tubing assembly, which may include coiled tubing injector 34 for deploying and retrieving coiled tubing into and out of the wellbore, blowout preventers 36 for controlling possible blowouts from the wellbore during operations, and test sub 38 for pressure testing. Swing arm crane 39 may also be secured to upper portion 18 of frame assembly 12 and is discussed in more detail further herein.

Figure 4:
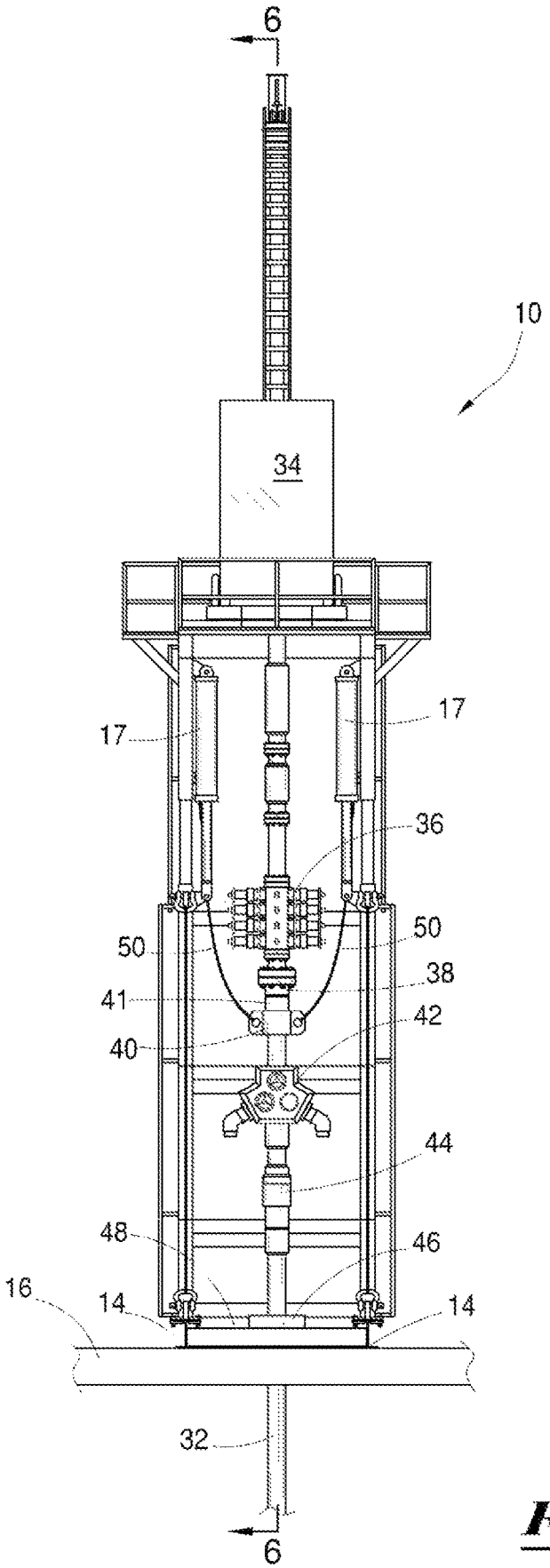
FIG. 4 is a front view of the compensator system in the position shown in FIG. 1.
Figure 5:
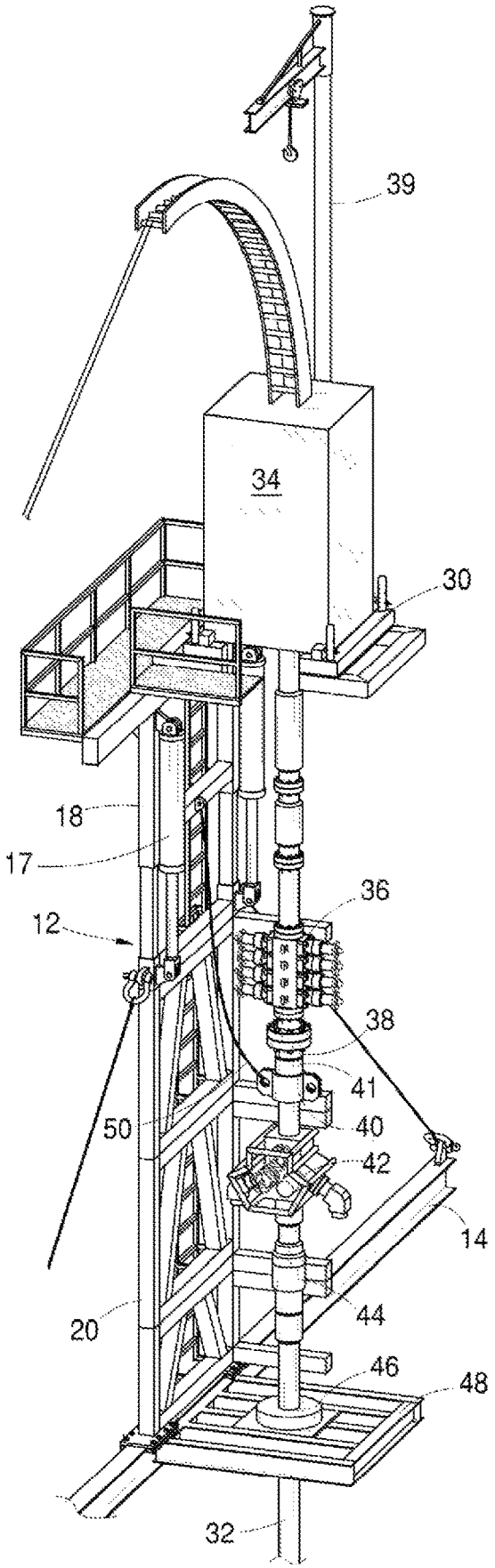
FIG. 5 is a perspective view of the first tool assembly secured to a tubular string with a frame assembly of the compensator assembly removed.
Figure 6:
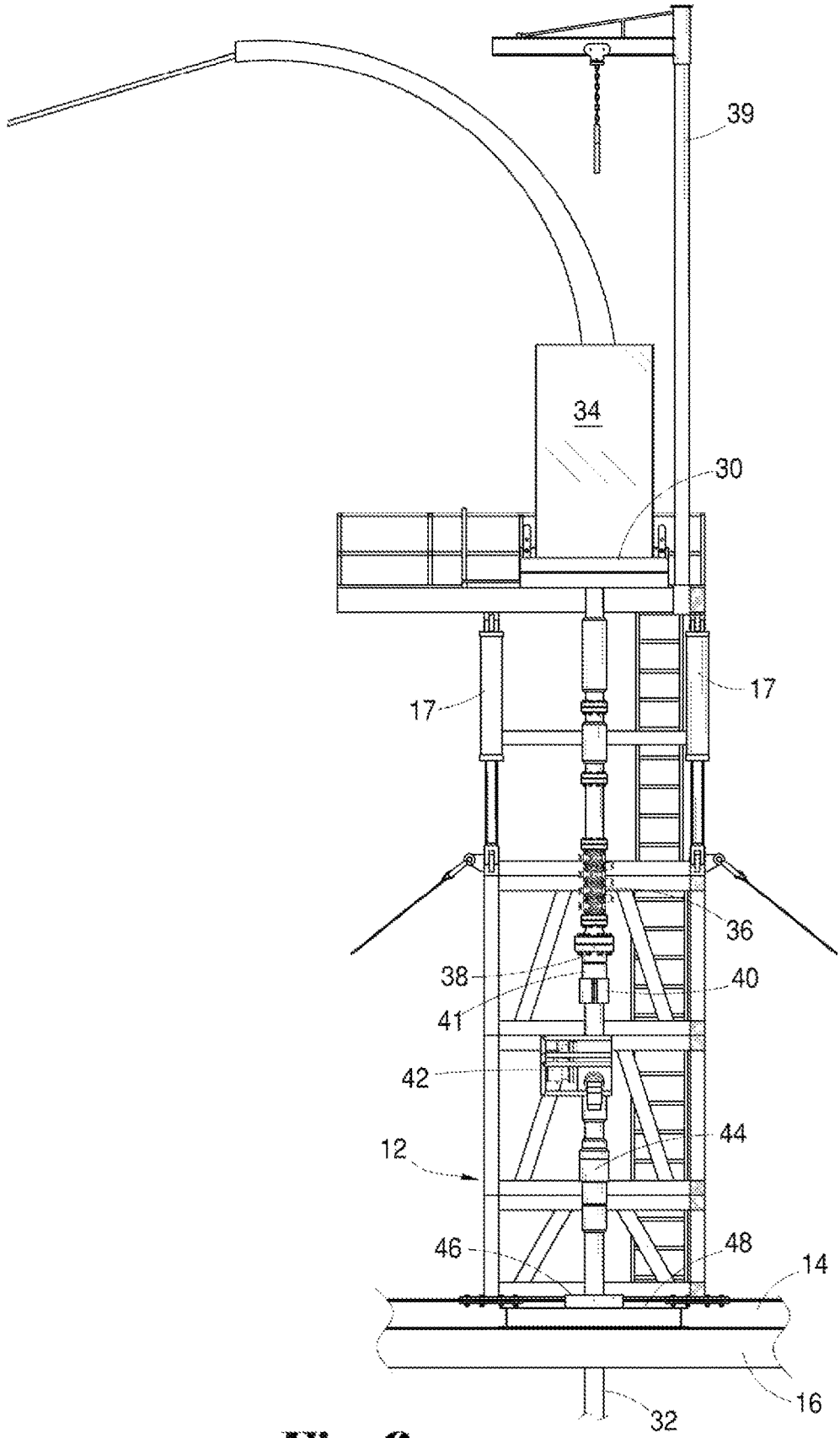
FIG. 6 is a side view of the first tool assembly secured to the tubular string as shown in FIG. 5.
Figure 7:
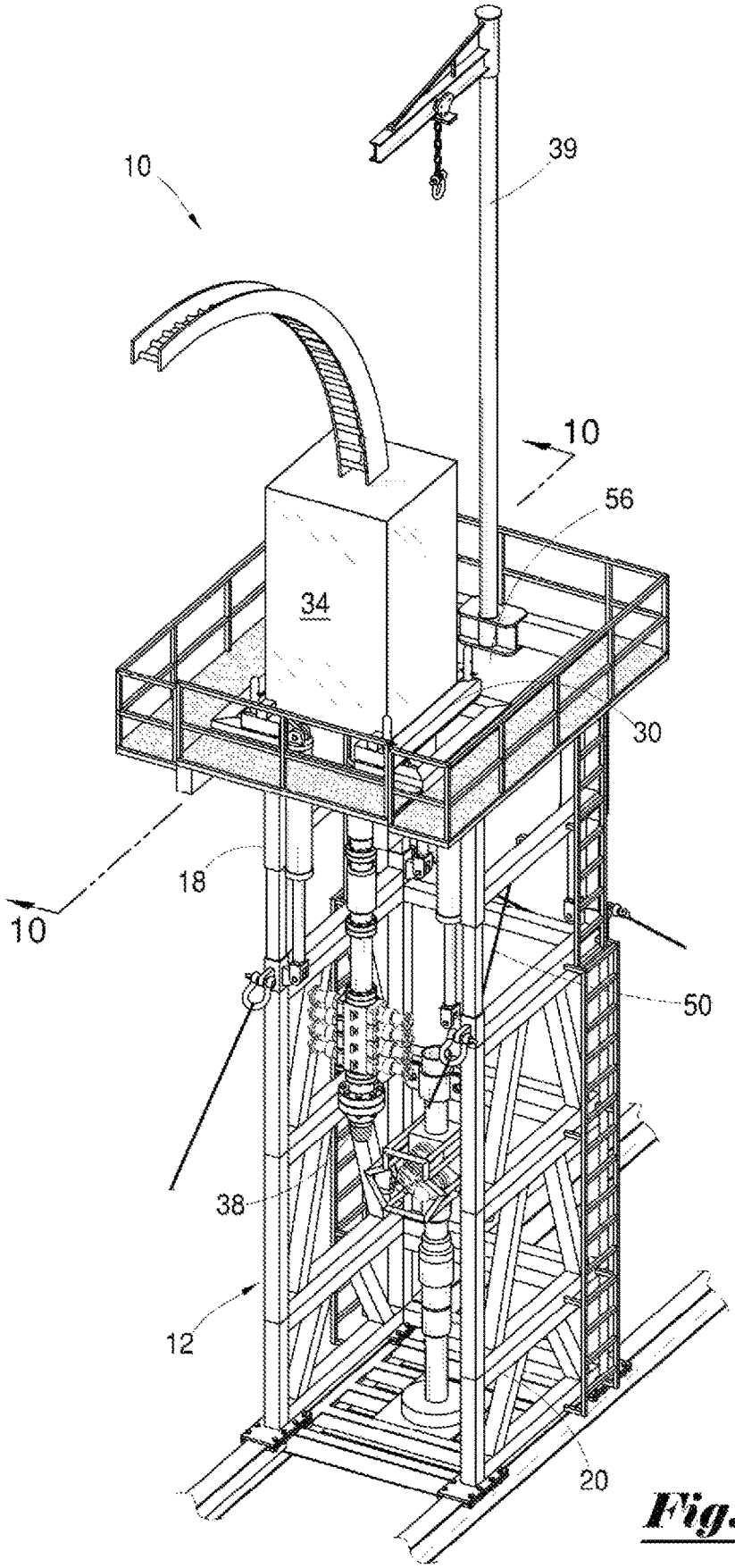
FIG. 7 is a perspective view of the compensator system with the sliding platform in the second position.
Figure 8:
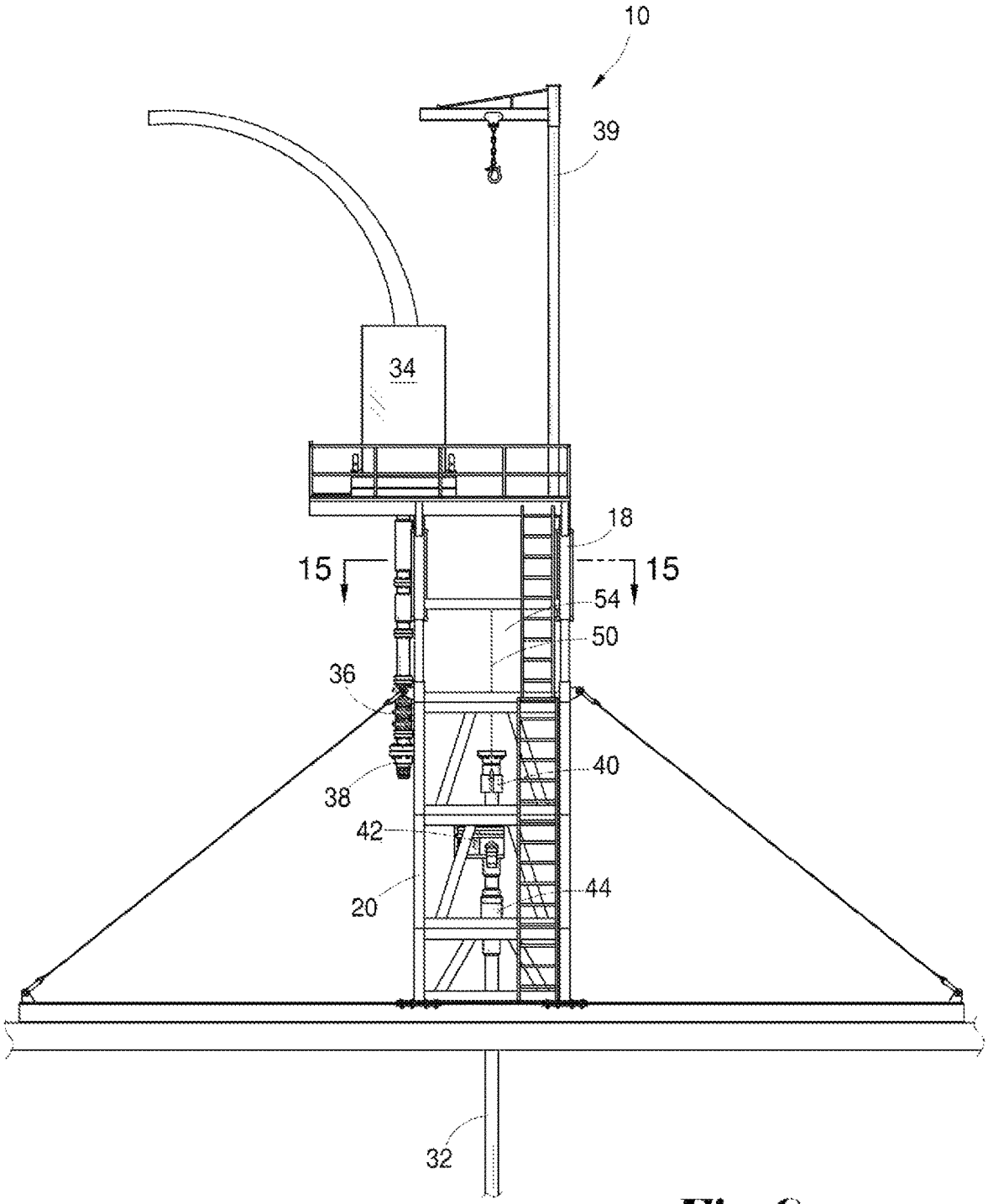
FIG. 8 is a side view of the compensatory system in the position shown in FIG. 7.
Figure 9:
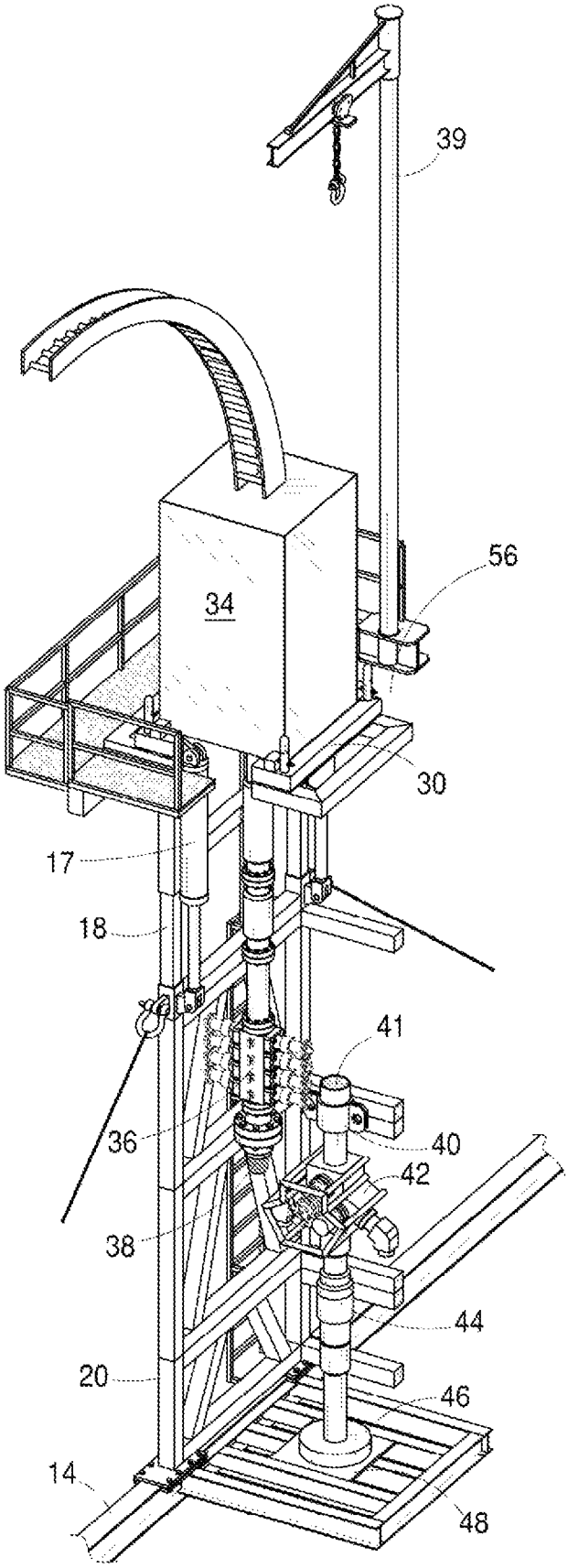
FIG. 9 is a perspective view of the first tool assembly in the second position with a frame assembly of the compensator assembly removed.
Figure 10:
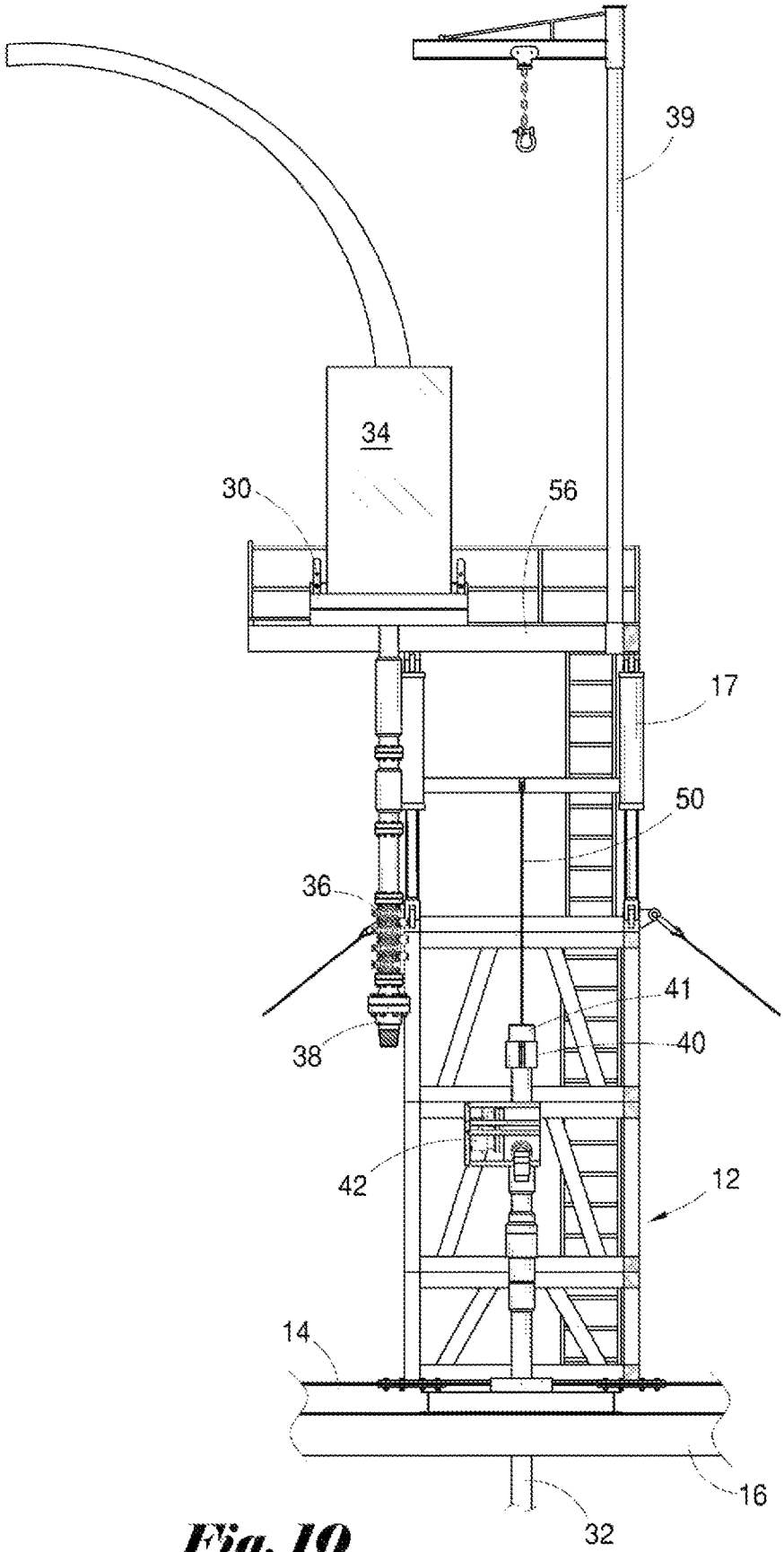
FIG. 10 is a side view of the first tool assembly in the second position as shown in FIG. 9.
Figure 11:
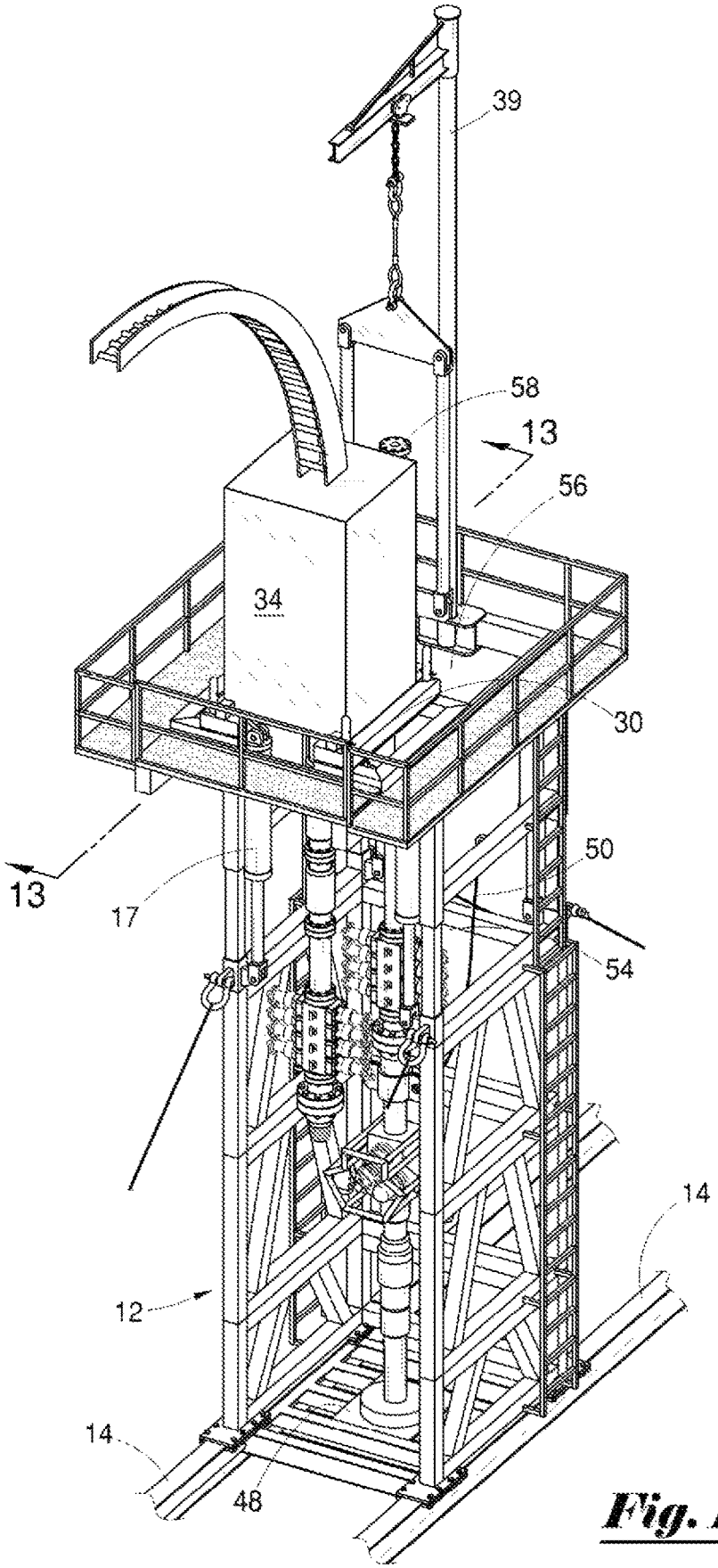
FIG. 11 is a perspective view of the compensator system with the sliding platform in the second position and a second tool assembly positioned in a central space of the frame assembly.
Figure 12:
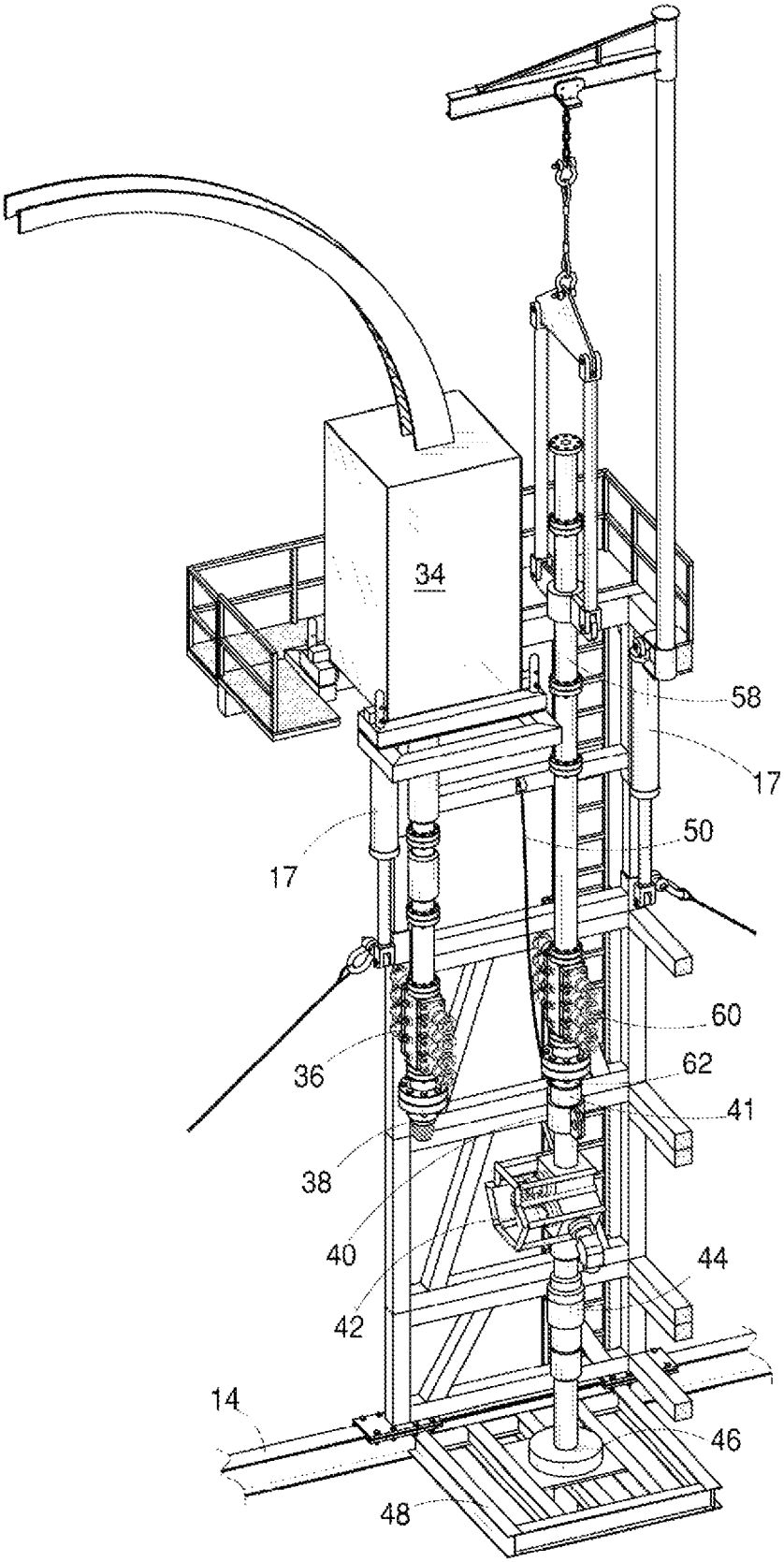
FIG. 12 is a perspective view of the first tool assembly and the second tool assembly as shown in FIG. 11 with a frame assembly of the compensator assembly removed.
Figure 13:
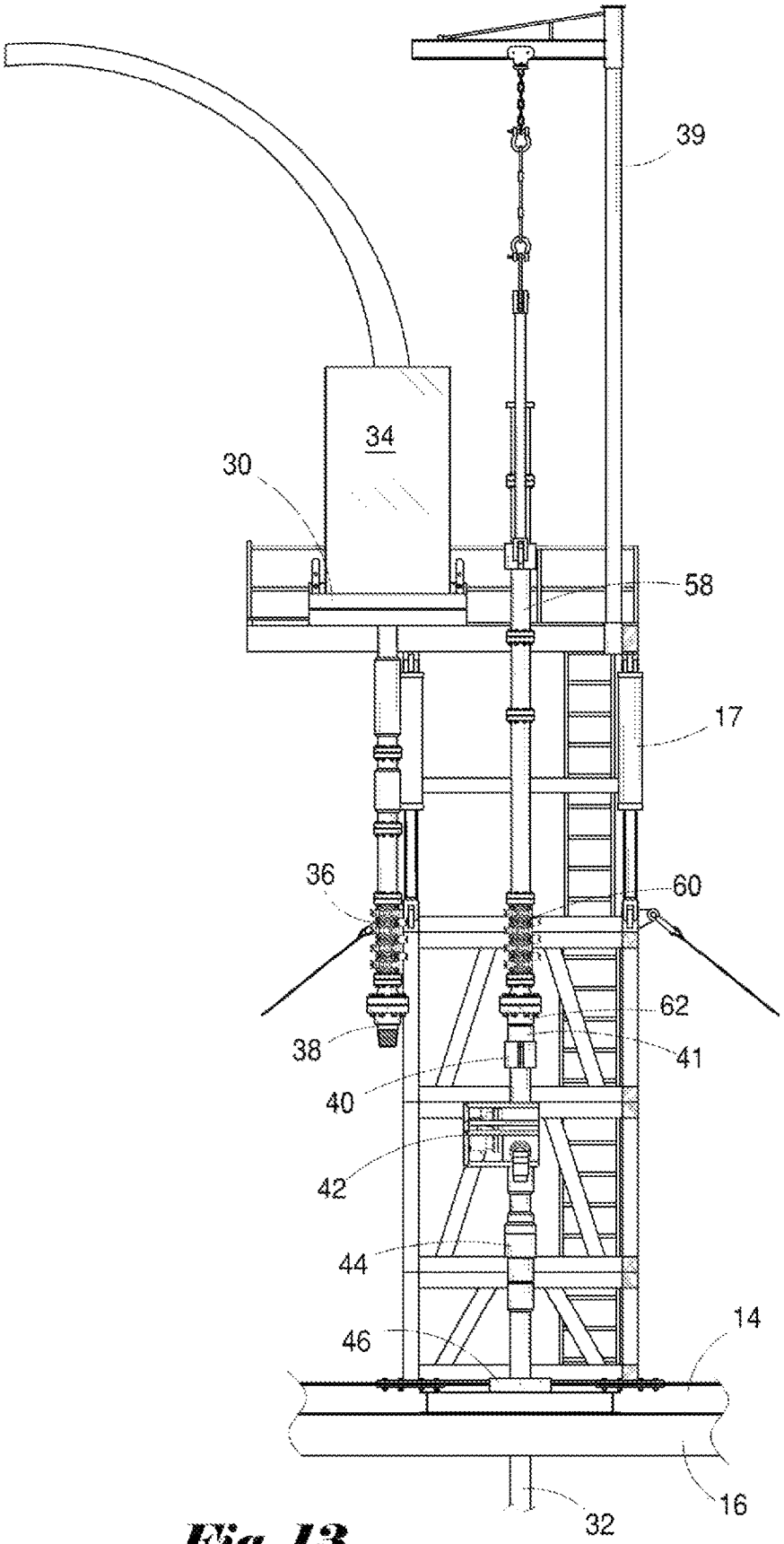
FIG. 13 is a side view of the first tool assembly and the second tool assembly as shown in FIG. 12.

Referring now to FIGS. 4-5, retainer 40 may be secured to tubular member 41 of a surface component of tubular string 32. Two or more supports 50 may extend between retainer 40 and upper portion 18 of frame assembly 12. In this way, retainer 40 and supports 50 may suspend tubular string 32. Supports 50 may include cables or pressure cylinders, such as hydraulic cylinders or pneumatic (e.g., nitrogen) cylinders (e.g., cylinders with reciprocating piston rods). In some embodiments, surface components include a spacer may be used in combination with retainer 40, such as below retainer 40. In some examples, retainer 40 includes an elevator, such as a side door elevator. In further examples, retainer 40 may include a side door elevator and two or more rings secured to the elevator for engaging the lower end of supports 50. In other examples, retainer 40 may include clamps configured to be secured to tubular member 41.

With reference to FIGS. 4-6 and 14, surface components of tubular string 32 may further include flow head 42, which may, among other things, control flow out of the wellbore. Flow head 42 may be disposed below tubular member 41 to which retainer 40 may be secured. In some embodiments, flow head 42 may be a ball valve flow head or a gate valve flow head. Surface components of tubular string 32 may also include inline swivel 44 for allowing rotation of tubular string 32 below. Compensation system 10 may further include bowl and slips 46 and false rotary 48 engaging the surface components of tubular string 32.

With reference to FIGS. 7-10, supports 50 may be placed in a tensioned position by lifting upper portion 18 of frame assembly 12 to expand frame assembly 12. Thereafter, the first tool assembly may be disconnected from tubular member 41 to which retainer 40 is secured. Retainer 40 may retain tubular member 41 in its vertical position. After the first tool assembly is disconnected, the first tool assembly, such as the coiled tubing assembly, may be moved into a second position that is out of line with the wellbore by sliding the sliding platform 30 in a horizontal direction. In this second position, central space 54 (illustrated in FIG. 8) and upper window 56 (illustrated in FIGS. 7 and 9-10) of frame assembly 12 are empty above tubular string 32.

Referring now to FIGS. 11-13 and 15, a second tool assembly may be positioned in central space 54 of frame assembly 12, such as by being lowered through upper window 56 with swing arm crane 39. In the illustrated embodiment, the second tool assembly includes a wireline assembly 58 having blowout preventer 60 and test sub 62. The second tool assembly may be secured to tubular member 41 to which retainer 40 is attached for use of second tool assembly in relation to drilling, intervention, plug and abandonment, or any other operations in the wellbore. Supports 50 may be maintained in the tensioned position the entire time that the second tool assembly is secured to tubular string. In this way, the second tool assembly and the tool string may be supported by the retainer 40, supports 50, and frame assembly 12, and the frame assembly 12 may expand and contract to compensate for sea motion and sea level changes in relation to the sea floor.

When operations involving the second tool assembly are complete, the second tool assembly may be disconnected from the tubular member 41 and removed from central space 54, such as through upper window 56 with swing arm crane 39. The supports 50 may be maintained in the tensioned position during these disconnection and removal steps. After the second tool assembly has safely cleared the frame assembly, the sliding platform 30 may slide from the second position back into the first position in which the sliding platform 30 and the first tool assembly are in line with the tubular string so that the first tool assembly may again be attached to the tubular member 41 to which retainer 40 is secured. Once first tool assembly is secured attached to the tubular string such that the upper portion of frame assembly 12 supports the load of the tubular string, supports 50 may be disconnected from retainer 40 and or removed from frame assembly. In other embodiments, however, supports 50 may remain connected to retainer 40 even when the first tool assembly is connected to the tubular string.

In each of the positions shown in FIGS. 1-16, the frame assembly 12 may be extended and retracted to compensate for sea movement in relation to the sea floor.

Figure 16:
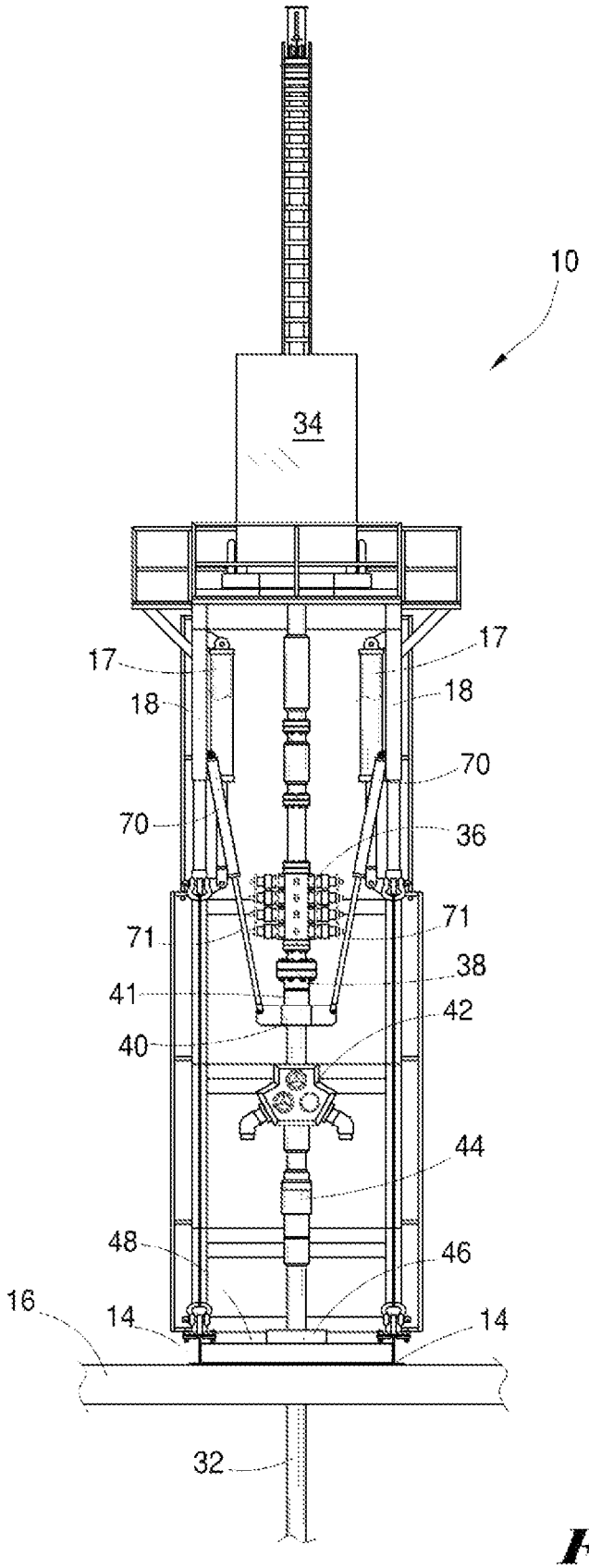
FIG. 16 is a front view of another embodiment of the compensator system.

FIG. 16 illustrates an embodiment in which the supports include cylinders 70 secured to the frame assembly 12 and retainer 40. Cylinders 70 may be pressure cylinders (e.g., hydraulic or pneumatic cylinders with reciprocating piston rods 71). For example, this embodiment may include any number of cylinders 70, such as two, three or four cylinders 70, which may be controlled with nitrogen.

Figure 17:
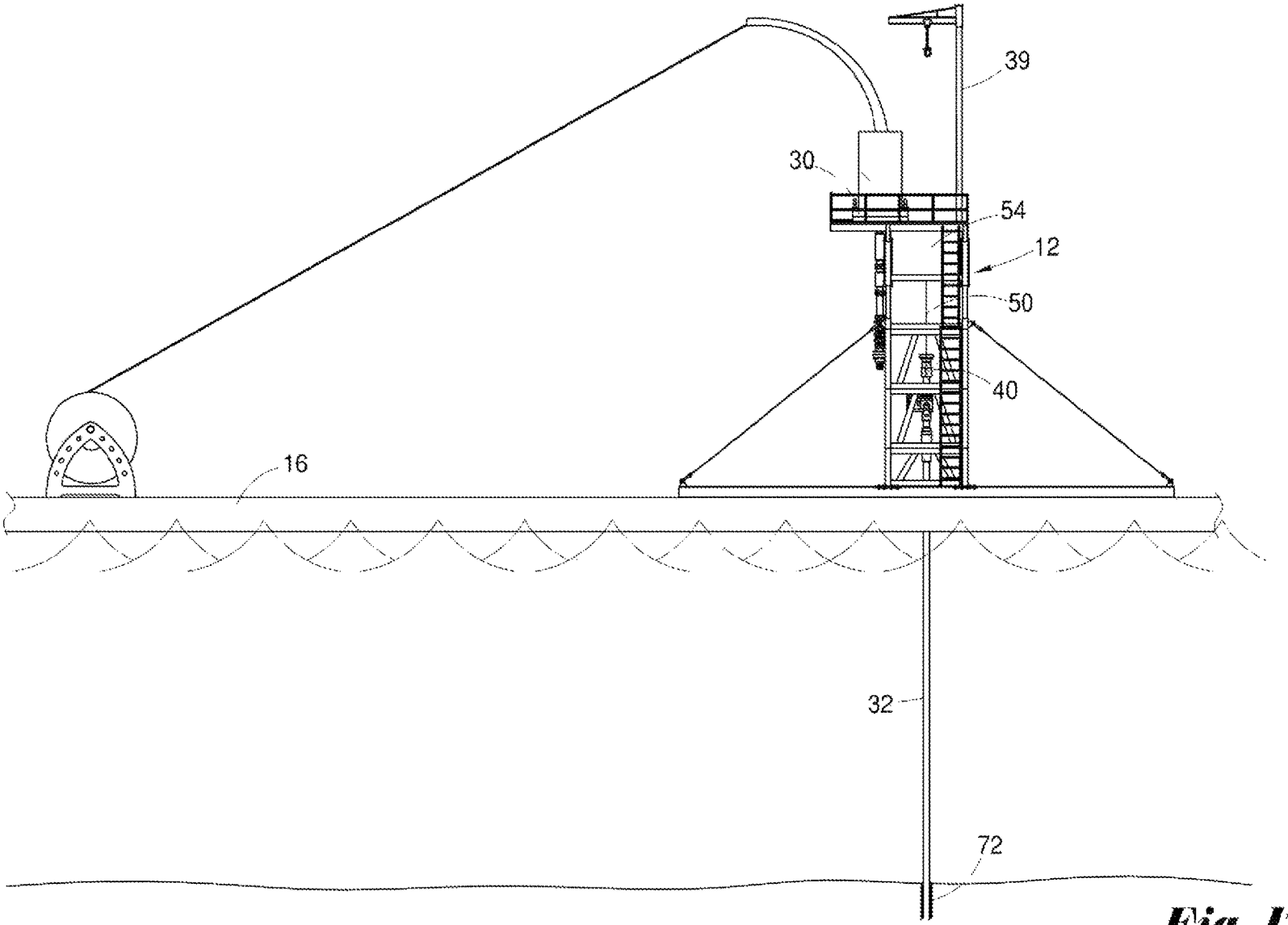
FIG. 17 is a side view of the compensator system positioned on a floating platform or vessel over a wellbore.

Referring now to FIG. 17, extendable frame assembly 12 may be positioned on floating platform or vessel 16 over wellbore 72. Frame assembly 12 may extend and retract to compensate for sea level change over time. Sliding platform 30 may be positioned in a first position over central space 54 of frame assembly 12 and may support a first tool assembly and tubular string 32 extending into wellbore 72 below. To disconnect the first tool assembly from the surface components of tubular string 32, frame assembly 12 may be extended to provide tension to supports 50 between frame assembly 12 and retainer 40. In this way, tubular string 32 may remain suspended above wellbore 72 after the first tool assembly is disconnected.

Sliding platform 30 may then be moved into a second position a horizontal distance from the first position such that the first tool assembly is out of line of wellbore 72. A second tool assembly may then be positioned in central space 54 of frame assembly 12 via swing arm crane 39 and connected to the surface components of tubular string 32. To disconnect the second tool assembly from the surface components of tubular string 32, frame assembly 12 may be extended to provide tension to supports 50 between frame assembly 12 and retainer 40. In this way, tubular string 32 may remain suspended above wellbore 72 after the second tool assembly is disconnected. The second tool assembly may then be removed from central space 54 of frame assembly 12 via swing arm crane 39.

Sliding platform 30 may be moved back into the first position, wherein the first tool assembly is in line with wellbore 72. The first tool assembly may then be connected to the surface components of tubular string 32.

In some embodiments, the compensator assembly may be configured for use on a floating platform, spar, or tension leg platform without a false rotary, bowl and slips, flow head, or inline swivel.

Each of the described components may be formed of steel. For example, the tubular body of rotary slip bowl 40 may be formed of 41/45 steel, rotary slip set 80 may be formed of 41/45 heat treated steel, and carrier 90 may be formed of schedule 40 steel pipe.

While preferred embodiments have been described, it is to be understood that the embodiments are illustrative only and that the scope of the invention is to be defined solely by the appended claims when accorded a full range of equivalents, many variations and modifications naturally occurring to those skilled in the art from a review hereof.

What is claimed is:

1. A compensator system comprising:

an extendable frame assembly having an upper portion and a lower portion, the upper portion being configured for vertical movement relative to the lower portion via a compensation assembly comprising one or more compensating cylinders;

a sliding platform disposed on the upper portion of the extendable frame assembly, the sliding platform configured to slide horizontally relative to the extendable frame assembly;

a retainer disposed within a central space of the extendable frame assembly, the retainer configured to be secured to a tubular member for supporting the tubular member and a tubular string below;

two or more supports extending from the upper portion of the extendable frame assembly to the retainer to suspend the retainer; and a swing arm crane secured to the upper portion of the extendable frame assembly;

wherein the sliding platform selectively slides between a first position over the central space and a second position a horizontal distance from the first position, wherein an upper window is opened when the sliding platform is in the second position, and wherein the sliding platform is configured to support a first tool assembly; and wherein the swing arm crane is configured to lift and lower a second tool assembly through the upper window when the sliding platform is in the second position.

2. The compensator system of claim 1, wherein each of the first tool assembly and the second tool assembly is a coiled tubing assembly, a wireline assembly, a slick line assembly, or an electronic line assembly.

3. The compensator system of claim 1, wherein the retainer includes an elevator.

4. The compensator system of claim 1, wherein the retainer includes a side door elevator.

5. The compensator system of claim 4, wherein the retainer further includes one or more rings secured to the side door elevator.

6. The compensator system of claim 1, wherein the retainer includes a clamp.

7. The compensator system of claim 1, wherein each of the two or more supports include a cable.

8. The compensator system of claim 1, wherein each of the two or more supports include a cylinder.

9. The compensator system of claim 8, wherein each cylinder of the two or more supports is a hydraulic cylinder.

10. The compensator system of claim 8, wherein each cylinder of the two or more supports is a nitrogen cylinder.

11. The compensator system of claim 1, wherein the compensator system includes four supports extending from the upper portion of the frame assembly to the retainer.

12. A method comprising the steps of:

a) providing a compensator system on a vessel or a floating platform, the compensator system comprising: an extendable frame assembly having an upper portion and a lower portion, the upper portion being configured for vertical movement relative to the lower portion via a compensation assembly comprising one or more compensating cylinders; a sliding platform disposed on the upper portion of the extendable frame assembly, the sliding platform configured to slide horizontally relative to the extendable frame assembly; a retainer disposed within a central space of the extendable frame assembly; two or more supports extending from the upper portion of the extendable frame assembly to the retainer to suspend the retainer; and a swing arm crane secured to the upper portion of the extendable frame assembly; wherein the sliding platform selectively slides between a first position over the central space and a second position a horizontal distance from the first position, wherein an upper window is opened when the sliding platform is in the second position, and wherein the sliding platform is configured to support a first tool assembly; and wherein the swing arm crane is configured to lift and lower a second tool assembly through the upper window when the sliding platform is in the second position;

b) positioning the compensator system over a wellbore with one or more surface components of a tubular string positioned within the central space of the extendable frame assembly, wherein the one or more surface components are suspended from the first tool assembly positioned on the sliding platform of the extendable frame assembly, and wherein the tubular string extends into the wellbore;

c) extending and retracting the extendable frame assembly to compensate for a sea level change over time with the first tool assembly connected to the tubular string in line with the wellbore;

d) securing the retainer to a tubular member of the one or more surface components;

e) adjusting a position of the extendable frame assembly to apply tension in the two or more supports extending from the upper portion of the extendable frame assembly to the retainer;

f) disconnecting the first tool assembly from the one or more surface components, and sliding the sliding platform to the second position the horizontal distance from the first position to transfer the first tool assembly out of line of the wellbore, wherein the two or more supports and the retainer supports a load of the one or more surface components and the tubular string below when the first tool assembly is disconnected; and g) extending and retracting the extendable frame assembly to compensate for a sea level change over time with the first tool assembly disconnected from the tubular string and out of line with the wellbore.

13. The method of claim 12, further comprising the steps of:

h) positioning the second tool assembly in the central space of the extendable frame assembly in line with the wellbore, and connecting the second tool assembly to the tubular member to which the retainer is secured; and i) extending and retracting the extendable frame assembly to compensate for a sea level change over time with the second tool assembly connected to the tubular string in line with the wellbore.

14. The method of claim 13, wherein each of the first tool assembly and the second tool assembly is a coiled tubing assembly, a wireline assembly, a slick line assembly, or an electronic line assembly.

15. The method of claim 13, wherein the first tool assembly is a coiled tubing assembly and the second tool assembly is a wireline assembly, a slick line assembly, or an electronic line assembly.

16. The method of claim 13, further comprising the steps of:

j) disconnecting the second tool assembly from the tubular member to which the retainer is secured, and removing the second tool assembly from the central space of the extendable frame assembly;

k) sliding the sliding platform from the second position into a position that is in line with the wellbore to position the first tool assembly above the tubular member to which the retainer is secured;

l) Attaching the first tool assembly to the tubular member to which the retainer is secured; and m) extending and retracting the extendable frame assembly to compensate for a sea level change over time with the first tool assembly connected to the tubular string in line with the wellbore.

* * * * *